US005078535A

United States Patent [19]

Kirkpatrick

[11] Patent Number: 5,078,535

[45] Date of Patent: Jan. 7, 1992

[54] LOCKING MEANS

[75] Inventor: Alan D. Kirkpatrick, Pine Brook, N.J.

[73] Assignee: Robud Co., Pine Brook, N.J.

[21] Appl. No.: 485,769

[22] Filed: Feb. 26, 1990

Related U.S. Application Data

[63] Continuation of Ser. No. 318,348, Mar. 2, 1989, abandoned.

[51] Int. Cl.[5] ..... B26D 7/20

[52] U.S. Cl. ..... 403/339; 83/347; 83/659; 83/698

[58] Field of Search ..... 70/30; 83/659, 346, 83/347, 698; 29/129.5, 130; 101/415.1; 403/339, 340, 341

[56] References Cited

U.S. PATENT DOCUMENTS

| | | | |
|---|---|---|---|
| 786,929 | 4/1905 | Williams | 403/341 X |
| 1,472,206 | 10/1923 | Burkle | 70/30 |
| 1,856,917 | 5/1932 | Jordan et al. | 403/341 |
| 2,446,018 | 7/1948 | Miskimen | 403/340 X |
| 3,633,246 | 1/1972 | Kirkpatrick | 83/659 X |
| 3,765,329 | 10/1973 | Kirkpatrick et al. | 83/659 X |
| 3,885,486 | 5/1978 | Kirkpatrick et al. | 83/659 |
| 4,031,600 | 6/1977 | Whigham | 83/659 X |
| 4,073,207 | 2/1978 | Kirkpatrick | 83/659 |
| 4,710,052 | 12/1987 | Elger | 403/341 X |
| 4,733,442 | 3/1988 | Asai | 403/341 X |
| 4,848,204 | 7/1989 | O'Connor et al. | 83/659 |
| 4,867,024 | 9/1989 | Cho et al. | 83/347 X |

*Primary Examiner*—Frank T. Yost
*Assistant Examiner*—Rinaldi Rada
*Attorney, Agent, or Firm*—John D. Kaufman

[57] ABSTRACT

Locking means for a cutting die blanket including male and female locking elements that may be quickly engaged with minimal effort. A series of shoulders, located in the female section, are provided to engage a ledge on the male section. The locking means is closed by forcing the male section into the female section through a series of steps wherein the ledge and shoulders cooperate to effect engagement.

2 Claims, 4 Drawing Sheets

LOCKING MEANS

This is a continuation of Ser. No. 07/318,348, now abandoned.

BACKGROUND OF THE INVENTION

The present invention relates to locking means for flexible elements. More particularly, the present invention relates to locking means for a flexible element to be wrapped and secured in cylindrical form. Typical of such elements is a cutting die blanket for use in conjunction with a cylindrical anvil roller in a rotary die cutting apparatus.

Rotary die cutting pertains to the art of cutting a moving workpiece, e.g. a continuously moving web or a sheet of material, without interrupting the movement of the workpiece. In typical application, moving webs or sheets of material, such as cardboard and corrugated paperboard, are passed between a cutting roller and an anvil roller. Cutting elements, known as cutting rules, are mounted on the cutting roller for rotation therewith. The anvil roller is provided with a cylindrical cover, known as a cutting die blanket, which fits around the surface of the anvil roller and effectively increases its diameter by twice the blanket thickness. The axes of rotation of the cutting roller and the anvil roller are parallel and displaced by an amount such that at their points of closest proximity the cutting rules penetrate the surface of the die cutting blanket.

As the cutting rules penetrate the surface of the die cutting blanket, a resistance to the penetration is developed which, for purposes of this application, is called a reaction force. Adjustment of the relative positions of the axes of rotation of the cutting die roller and the anvil roller is made to provide a degree of penetration, and therewith a degree of reaction force, sufficient to insure complete cutting of the moving web of material.

One of the most critical problems confronting developers of cutting die blankets has been the construction of blanket-locking structures that permit their rapid assembly and removal with little effort. One example of a cutting die blanket may be found in U.S. Pat. No. 4,073,207. Although the blanket-locking structure disclosed therein, and similar locking devices, have generally served the purpose, they have not proved entirely satisfactory in that considerable effort is often required in the assembly of the blanket on the die cylinder. Such difficulties can have serious consequences. For example, in the rotary die cutting field the machinery normally operates automatically at relatively high speeds thereby generating vast productivity with relatively small labor requirements. Any work stoppages or additional labor requirements caused for die blanket maintenance can clearly be expensive. It is evident, therefore, that when worn die blankets must be replaced it would be desirable to have a system whereby the worn blanket can be quickly removed and replaced with a fresh blanket using a minimum of time and labor. The present invention fills this need.

SUMMARY OF THE INVENTION

The general purpose of this invention is to provide a locking means that has all of the advantages of similarly employed devices and also over comes the above described disadvantages. To attain this, the present invention provides a unique combination of female and male locking elements mounted at opposite ends of a flexible member whereby cooperating structures in the locking elements permit a single person to quickly assembly and disassemble the blanket using simple tools. More specifically, the female locking element has multiple compressible shoulders opposed to noncompressible surfaces between which the male locking element is inserted. The male locking element has opposed compressible and noncompressible surfaces for cooperating with the female locking element. As such, a user, during assembly, can insert the male locking element into the female locking element by gradually advancing the elements into cooperative engagement between the multiple compressable shoulders and the noncompressible surface of the male element.

The exact nature of this invention as well as other objects and advantages thereof will be readily apparent from consideration of the following specification relating to the annexed drawing in which:

DETAILED DESCRIPTION OF THE PREFERRED EMBODIMENT

Figure 1:
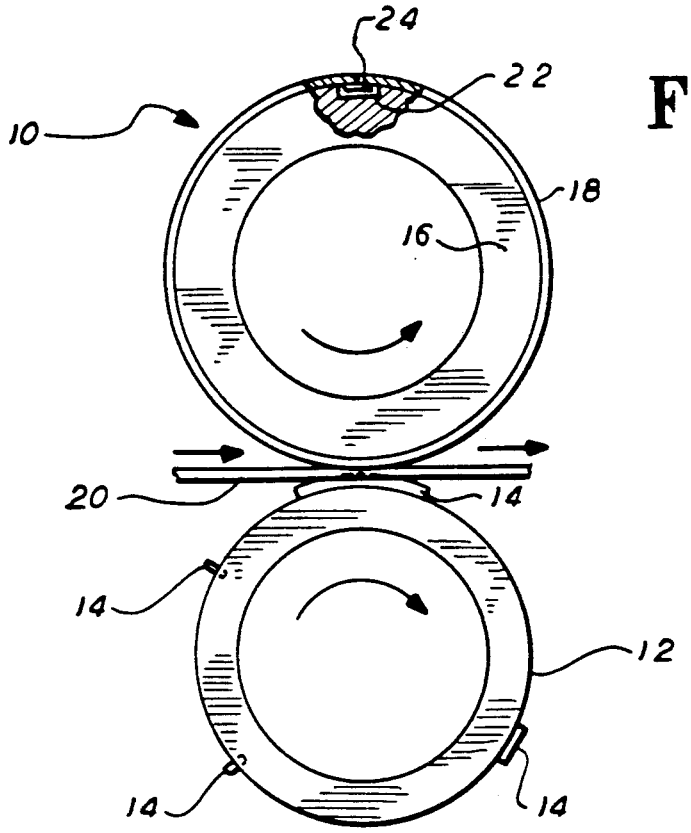
FIG. 1 is a schematic side elevational view of a rotary die cutting apparatus having a cutting die blanket incorporating locking structures according to the present invention.
Figure 4:
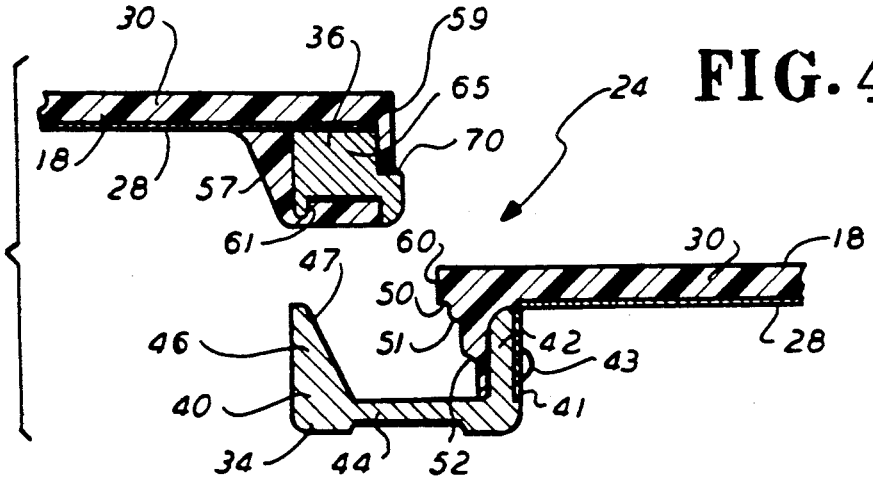
FIGS. 4. 5. 6 and 7 are side elevational views in section of a portion of the invention in various stages of assembly.

Referring to FIG. 1, there is shown schematically a rotary die cutting apparatus designated generally by the reference numeral 10. Die cutting apparatus 10 includes a cutting roller 12 having a plurality of cutting knives or rules 14 mounted thereon and an anvil roller 16 having mounted thereon a cutting die blanket 18 structured in accordance with the present invention.

Rotary die cutting apparatus 10 is shown in FIG. 1 to be cutting a web of material 20, e.g, cardboard, as it passes between rollers 12 and 16 from left to right as shown. Cutting roller 12 and anvil roller 16 rotate in the clockwise and counterclockwise directions, respectively, at an angular rate which is such as to cause their surface velocities to be identical at their common line of tangency to the speed of advance of web 20. This relationship permits cutting of the web material in what is substantially a radially-directed in and out motion.

Formed in the periphery of anvil roller 16 is a slot 22 which extends transversely across the surface of roller 16 in a line generally parallel to the axis of rotation of roller 16. Slot 22 is adapted to receive the locking element 24 of cutting blanket 18 such as to secure blanket 18 rigidly to the anvil roller 16 for rotation and operation therewith. Thus, during set-up of apparatus 10, the cutting die blanket 18 according to the invention is wrapped around anvil roller 16 and positioned peripherally angularly such that locking structure 24 is received within slot 22.

Referring now to FIGS. 2–9 there is shown a cutting die blanket 18 incorporating locking structure 24 according to the present invention. Blanket 18 comprises a split ring annular band 28 having a composite coating 30 thereon, the ends of each forming a portion of the locking structure 24. Split ring band 28 may be fabricated from any of the flexible materials which are known conventionally to be employed as backings for cylinder covers. e.g. thin sheet metal, thin fiber sheets, wire reinforced rubber or the like. A typical band dimensionally can be expected to be up to 60 inches long and from 8 to 12 inches wide. In this regard the dimensions of any particular band or series of bands are determined by the dimensional characteristics of the anvil rollers for which they are to be used.

The blanket material 30, i.e., the composite coating, can be chosen from any of the known blanket materials such as polyurethane, polyvinyl chloride, chlorinated butyl rubber and the like. The blanket material is bondcast onto the surface of band 28 whereafter the desired uniform thickness is achieved by precision grinding.

As is clear from the drawings, the blanket material 30 is integral with and forms a part of the locking structure 24. The locking structure 24 of the blanket 18 can be seen to comprise a female section designated generally by the reference numeral 34 and a male section designated generally by the reference numeral 36.

Female section 34 comprises a generally U-shaped channel 40 to which is bonded the blanket material 30 and to which is mechanically secured split ring band 28. More specifically, split ring band 28 is bent at its end to form a flange 41 which is in surface-to-surface engagement with an outer surface of one wall 42 of channel 40. Flange 41 and channel 40 are rigidly secured by a plurality of transversely spaced rivets 43 which extend through suitable openings formed in flange 41 and the wall 42 of channel 40.

It should be noted that split ring band 28 and channel 40 are secured by rivets 43 prior to the molding of blanket material 30 thereon in order to permit the swaging of the inner ends (not shown) of the rivets 43. It will be recognized by those skilled in these arts that other securing means than rivets 43 may be used.

Channel 40 also includes a base wall 44 and a side wall 46 having a tapered inside surface 47. The coating 30 covers the inside surface of wall 42 and includes a squared-off butt surface 60 and three stepped shoulders 50, 51, 52. The verticle height of surface 60 is, substantially equal to the thickness of blanket 18. Each of the shoulders 50, 51, 52 are slightly tapered for a purpose to be described below.

Figures 2, 3:
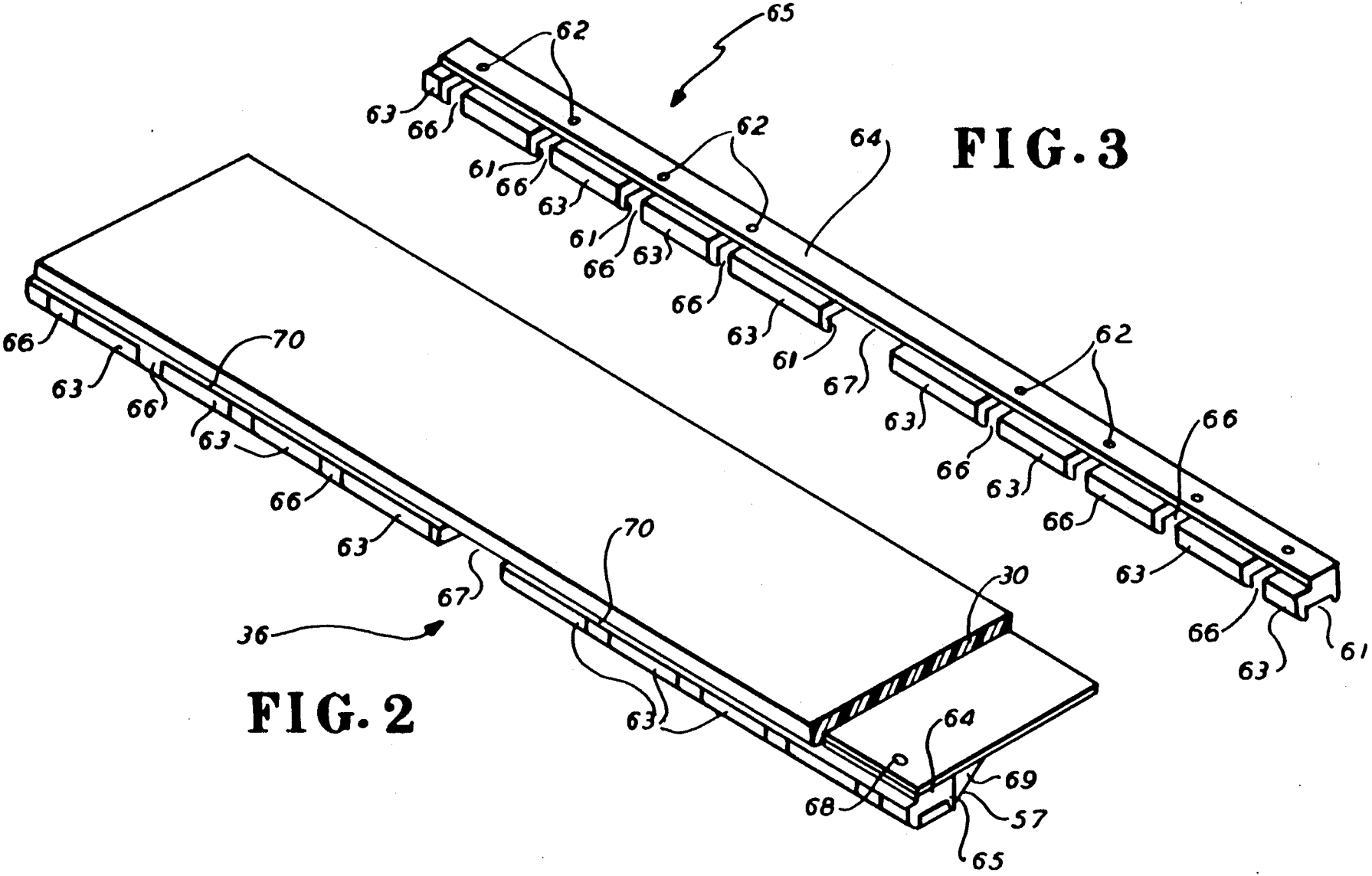
FIG. 2 is a perspective view, partly in section, of a portion of the preferred embodiment.
FIG. 3 is a perspective view of a portion of the invention.
Figure 8:
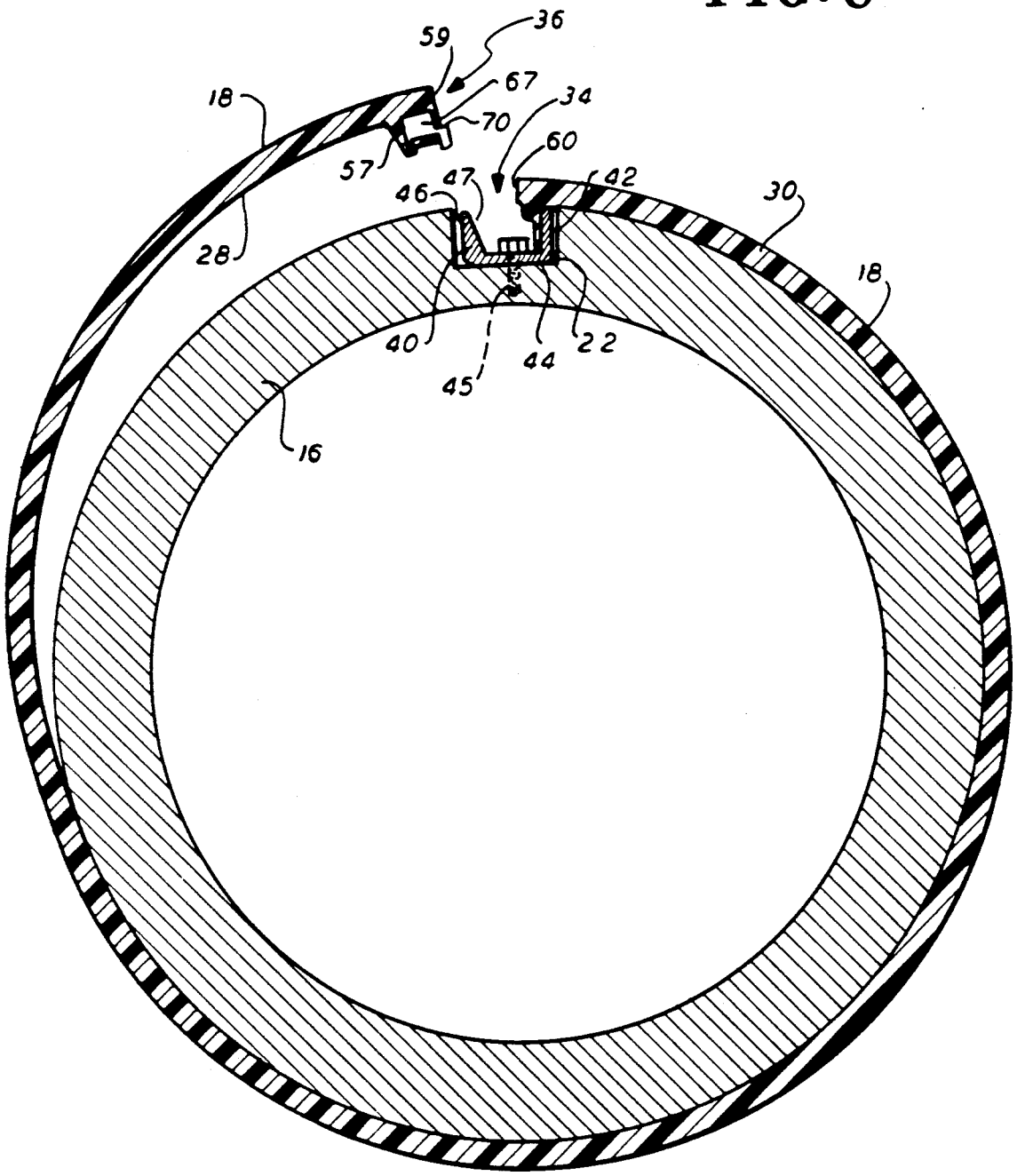
FIG. 8 is a side elevational view in section of the invention.

Now, with particular reference to FIGS. 2 and 3, male section 36 includes an insert 65 having an elongated bar 64 with a plurality of spaced, inverted U-shaped lugs 63 extending from the underside thereof to form a channel 61. A series of rivet holes 62 are formed in bar 64 and are contiguous with gaps 66 located between spaced lugs 63. A gap 67, located substantially at the center of insert 65, provides clearance for a bolt 45 that attaches U-shaped channel 40 of female section 34 in slot 22 of roller 16 (FIG. 8).

To assemble the male section 36, the end of band 28 is placed over bar 64 and riveted thereto with rivets 68 that pass through holes 62. When the coating 30 is applied to band 28, it overlaps the end thereof and forms a butt end 59 that leaves a horizontal ledge 70. The underside of insert 65 is also covered with the coating material to fill U-shaped channel 61. Finally the coating material overlaps one of the legs of the U-shaped channel 61 and extends at an angle to the underside of band 28 to form a wedge 57.

Figure 5:
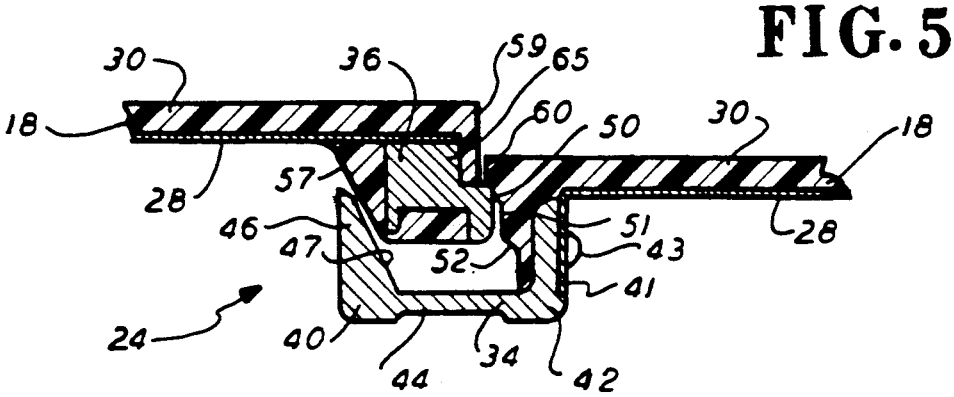
Figure 6:
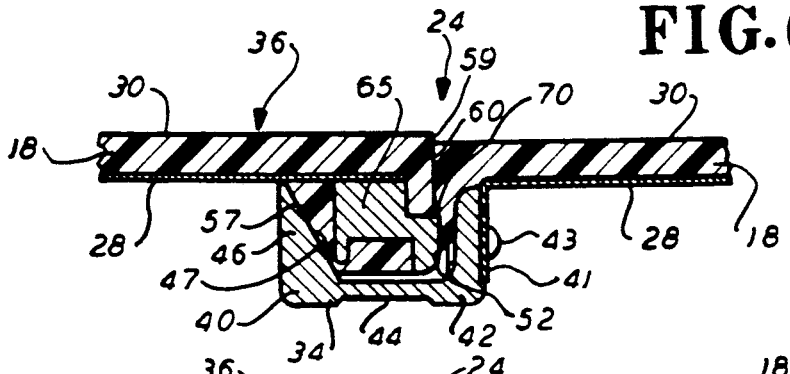

Except for the stepped shoulders 50, 51, 52, the cross-sectional shapes of the female section 34 and the male section 36 are congruent. Each shoulder 50, 51, 52 is dimensioned so as to be capable of overlapping ledge 70 when the male and female sections 36, 34 are mated at three separate depths with wedge 57 abutting surface 47 (FIGS. 5–7).

Figure 7:
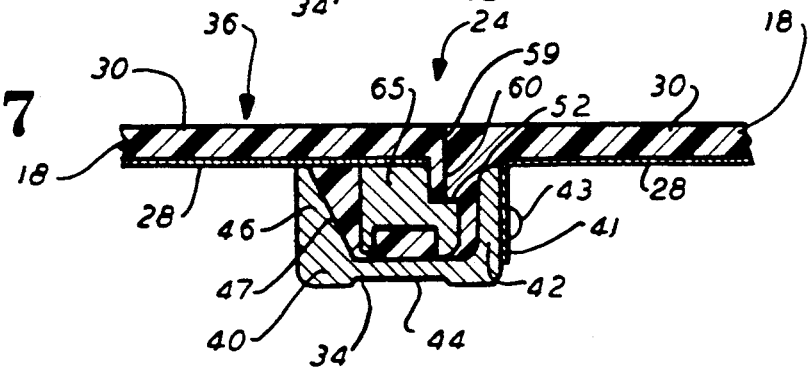
Figure 9:
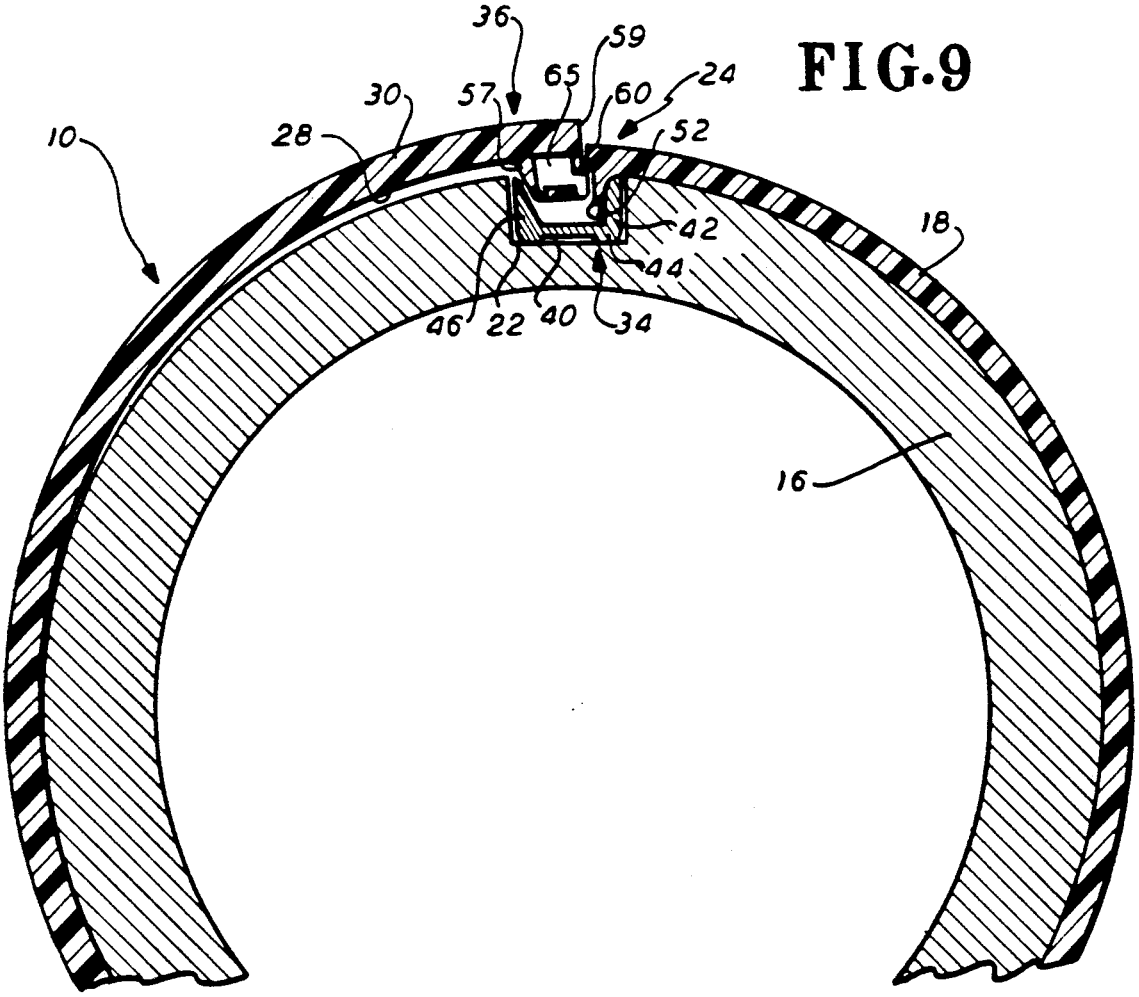
FIG. 9 is a side elevational view in section of the invention.

Additionally, as can be seen in FIG. 7, when the male section 36 is fully inserted in the female section 34, the shoulder 52 will overlap ledge 70, the surfaces 59, 60 will abut and be in compression, the compressible surface of wedge 57 will abut noncompressible surface 47, and the compressible surface of the coating material in channel 61 will rest against the base wall 44.

As such, it can be seen from FIGS. 4–7 that the compressible shoulders 50, 51, 52, in cooperation with noncompressible ledge 70, provide a means for locking the locking structure 24 in small steps so that locking can be accomplished gradually by a single person.

The noncompressible ledge 70 can be made to snap under the compressible shoulder 50 by forcing the section 36 into section 34 so that surface 60 and wedge 57 will be compressed. To best accomplies this locking step, the user may start at one side of the blanket 18 and then move along the length of the structure 24, gradually working the ledge 70 under shoulder 50 by applying successive blows with a mallet or the like. After ledge 70 is under shoulder 50, the user may then return to one of the sides of the blanket and proceed in the same fashion to gradually force the ledge 70 under shoulder 51 with successive blows along the length of male section 36. The same process may be repeated to finally drive the male section 36 home with the ledge 70 under shoulder 52.

As mentioned earlier, the shoulders 50, 51, 52 are slightly tapered. This shape is provided so that the ledge 70 will more easily slide under the various shoulders 50, 51, 52. The wedge 57 and tapered surface 47 cooperate to put tension on the blanket 18 so it will be pulled into tight engagement with the roller 16 while the locking structure 24 is being engaged. Hence, it is palpable that the blanket 18 is capable of providing a firm, uniform surface for use on roller 16. It is also evident that locking structure 24 can be quickly engaged by a single user. Removal of the cover 18 may also be accomplished quickly by simply forcing a sharp bar into the relatively soft material in channel 61 and wedging the male section 36 out of female section 34. Alternatively, a flat lever could be forced between surfaces 59 and 60 and then used to pry the sections 34, 36 apart. Of course the surface 60 and shoulders 50, 51. 52 could also be removed with a cutting device. e.g, a circular saw, by cutting through the soft coating 30 to quickly separate the locking structure 24.

Obviously many modifications and variations of the present invention are possible in the light of the above teachings. For example, the blanket 18, being described here as mounted on the anvil roller 16, could instead be mounted on other cylindrical devices. A typical free-wheeling cylinder, for use on an anvil roller, could also receive the blanket 18. It is therefore to be understood that, within the scope of the appended claims, the invention may be practiced otherwise than as specifically described.

What is claimed is:

1. A locking means comprising:

an elongated flexible element having first and second ends;

a male locking element disposed on said first end, said male locking element including a ledge formed of relatively non-compressible material and extending beyond said first end; and a female locking element disposed on said second end, said female locking element including a stepped surface formed of relatively compressible material adjacent said second end, said stepped surface defining at least two shoulders for cooperating with said ledge to retain said male locking element within said female locking element selectively in at least two positions corresponding to the locations of said shoulders.

2. A locking means comprising:

an elongated flexible element having first and second ends;

a male locking element disposed on said first end, said male locking element including a ledge extending beyond said first end; and a female locking element disposed on said second end, said female locking element including a stepped surface formed adjacent said second end, said stepped surface defining at least two spaced shoulders for cooperating with said ledge to retain said male locking element within said female locking element selectively in at least two positions corresponding to the locations of said shoulders, at least one of said spaced shoulders being defined by a tapered surface.

* * * * *